United States Patent [19]

Behrens et al.

[11] Patent Number: 4,913,572

[45] Date of Patent: Apr. 3, 1990

[54] RELOADABLE RIBBON CASSETTE FOR TYPEWRITERS OR OFFICE MACHINES OF SIMILAR CONSTRUCTION

[75] Inventors: Rolf Behrens, Oldenburg; Hermann Jendricke, Varel; Manfred Sauer, Wilhelmshaven; Klaus D. Frerichs, Schortens; Alfred Keiter, Wilhelmshaven; Andreas Wesselhöft, Gifhorn; Hans P. Heins; Heinz Lange, both of Wilhelmshaven, all of Fed. Rep. of Germany

[73] Assignee: AEG Olympia Office GmbH, Wilhelmshaven, Fed. Rep. of Germany

[21] Appl. No.: 122,164

[22] Filed: Nov. 18, 1987

[51] Int. Cl.[4] ..... B41J 35/28; B41J 32/00

[52] U.S. Cl. ..... 400/207; 400/208.1; 400/242

[58] Field of Search ..... 400/207, 208, 208.1, 400/242, 238, 250, 235, 236, 243, 244, 245, 246, 248

[56] References Cited

U.S. PATENT DOCUMENTS

| | | | |
|---|---|---|---|
| 3,731,781 | 5/1973 | Cavelill et al. | 400/208 |
| 4,368,992 | 1/1983 | Sagnebin | 400/208 |
| 4,605,327 | 8/1986 | Oehi et al. | 400/208 |
| 4,616,845 | 10/1986 | Kamplin | 400/208 |
| 4,780,010 | 10/1988 | Behrens et al. | 400/208 |

FOREIGN PATENT DOCUMENTS

| | | | |
|---|---|---|---|
| 157076 | 10/1985 | European Pat. Off. | 400/208 |
| 2553329 | 7/1983 | Fed. Rep. of Germany . | |

*Primary Examiner*—Edgar S. Burr
*Assistant Examiner*—Ren Yan

[57] ABSTRACT

Ribbon cassettes for typewriters or office machines of similar construction are subject to differnt structural requirements and primarily they are to be easily exchangeable in a one-hand operation. Since additionally the ribbon cassettes are also designed as disposable components, many still functional individual parts are also discarded. To avoid this, ribbon cassettes are known which have exchangeable ribbon spools. It is the object of the invention to provide a reloadable ribbon cassette in which the exchange of ribbon spools (4, 5) is possible with few manipulations. The removal of the spent ribbon spools (4, 5) should here be possible without soiling the fingers. This problem is solved in that the take-up spool (5) and the supply spool (4) are arranged to be freely placeable onto bearing pins (11, 12) in the bottom member (6) and the movable parts for guiding and transporting the ribbon (8) in the bottom member (6), which has a cup-shaped configuration, are mounted on one side and, except for the take-up spool (5) and the supply spool (4) which are freely placeable onto the bearing pins (11, 12), are arranged to be arrestable against falling out of the cassette housing if the cover (2) is open. This permits exchange of the ribbon spools (4, 5) with few manipulations without the operator performing this exchange soiling his/her fingers. The exchange of ribbon spools (4, 5) is also possible for less experienced operators not having special skills.

12 Claims, 2 Drawing Sheets

RELOADABLE RIBBON CASSETTE FOR TYPEWRITERS OR OFFICE MACHINES OF SIMILAR CONSTRUCTION

BACKGROUND OF THE INVENTION

The invention relates to a reloadable ribbon cassette for a typewriter or office machine of similar construction of the type having an opening closable by a cover in the top of a cassette housing for the exchange of a supply spool for unwinding and a take-up spool for winding up a ribbon, with the supply and take-up spools being controllable by means of a plurality of movable drive parts arranged in an operative configuration for guiding and transporting said ribbon including a braking device for blocking and releasing said supply spool and a feed roller, the take-up spool being driven by means of said feed roller equipped with a sprocket wheel which can be brought into engagement with the ribbon by means of a spring.

U.S. Pat. No. 3,731,781 discloses a removable cassette for a carbon ribbon to be used in a printer having a rotatable drive element for ribbon advance, with the cassette being composed of a housing accommodating a ribbon supply spool and a take-up spool. A pivotal feed roller equipped with a sprocket wheel here cooperates with a take-up spool disposed on a stationary axis to wind up the carbon ribbon. For exchanging the cassette, the feed roller and the sprocket wheel must first be put out of engagement with the take-up spool. This exchange process requires a plurality of manipulations since, after insertion of the new cassette in the receiving device of the machine, the feed roller must also be brought back into engagement with the take-up spool.

German Patent No. 2,553,329 discloses a ribbon cassette for a typewriter or office machine of a similar construction in which the feed roller and its sprocket wheel are disposed in the cassette. The feed roller here remains in constant engagement with the carbon ribbon on the take-up spool. In this way it is possible to perform the exchange of ribbon cassettes with only one hand. This prior art ribbon cassette is very expensive since the members for driving the carbon ribbon contained in the ribbon cassette ar discarded together with the ribbon when it is used up. Since, moreover, the feed roller is always in engagement with the take-up spool and the drive elements are mounted, on the one hand, in the bottom portion and, on the other hand, in the cover which is fixed to the bottom portion, it is not possible to exchange the supply and take-up spools.

The above-mentioned drawbacks are overcome by DE-OS 3,524,730.4 in that the ribbon cassette is provided with a cover which closes an opening and that a supply spool for unwinding and a take-up spool for winding up the ribbon are freely placeable onto and rotatable on bearing pins in the cassette. The free end of the ribbon from the full supply spool is here provided with a fastening means serving to thread the ribbon around guide points in the cassette and being fixable to the core of the take-up spool in order to wind up the ribbon. With this cassette, the operator performing the exchange of spools still must have a certain amount of skill to properly thread the ribbon without permitting drive and guide elements disposed in the cassette to fall out of the cassette.

SUMMARY OF THE INVENTION

It is the object of the invention to provide a reloadable cassette having a cover for closing an opening, with the spent ribbon spools being easily removable from the cassette without soiling fingers and without requiring special precautionary measures. This problem is solved by providing a cassette with the drive components secured to the bottom of the cassette so that the components remain in an operative configuration when the tap is opened.

The advantage of the cassette is that, with the cover open, the supply and take-up spools can easily be removed from the cassette when the ribbon is spent without it being necessary to touch the spools themselves. The guide and transporting elements are no longer able to fall out of the cassette during this exchange process. After exchange of the ribbon spools, the reloadable cassette can be returned to the receptacle in the machine by one-hand operation.

BRIEF DESCRIPTION OF THE FIGURES

Further advantageous features of the invention are defined in the further dependent claims. Features of the invention are described in greater detail below with reference to embodiments which are illustrated in the drawing figures. It is shown in:

DETAILED DESCRIPTION OF AN EXEMPLARY EMBODIMENT

Figure 1:
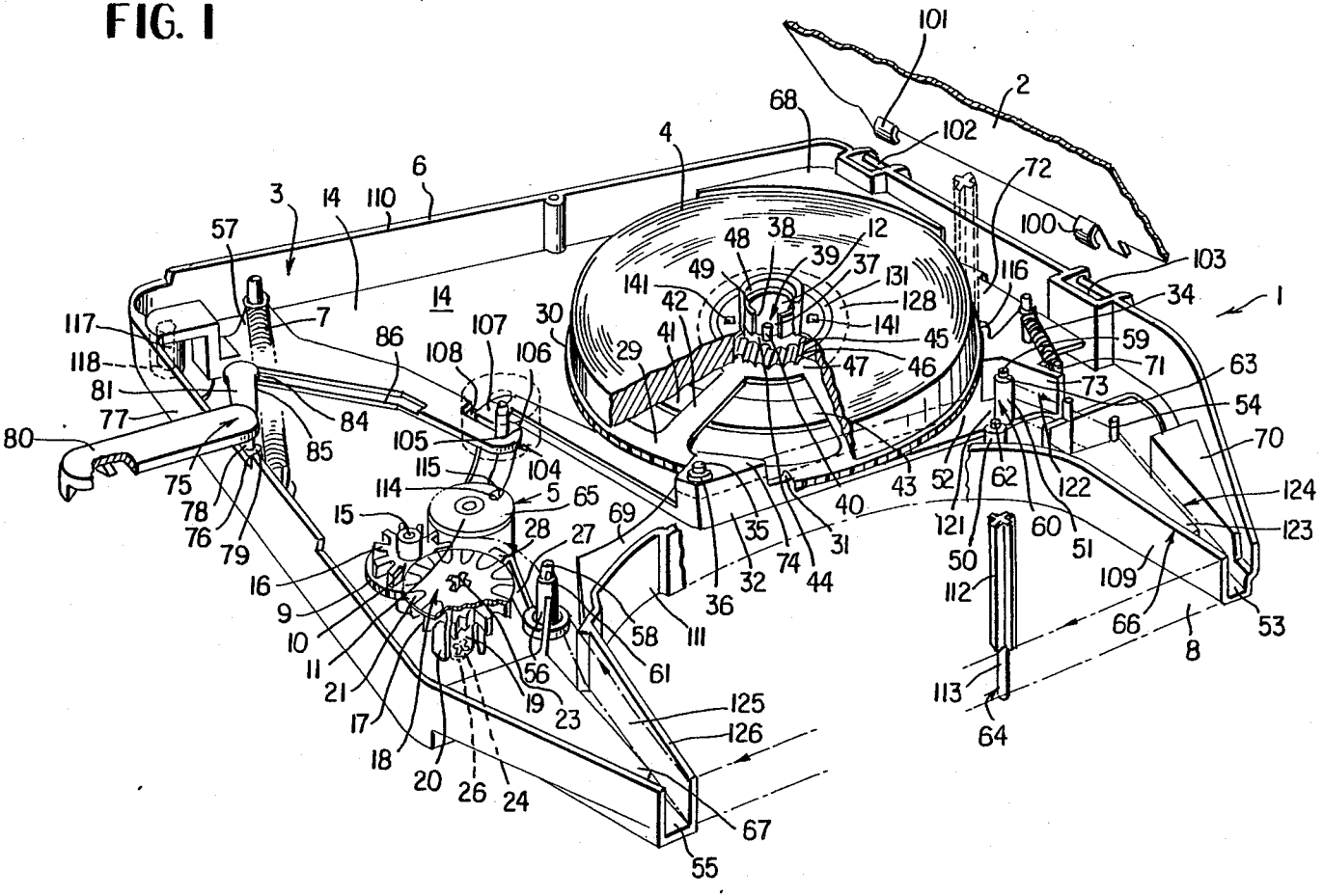
FIG. 1, a reloadable cassette with its cover open.
Figure 2:
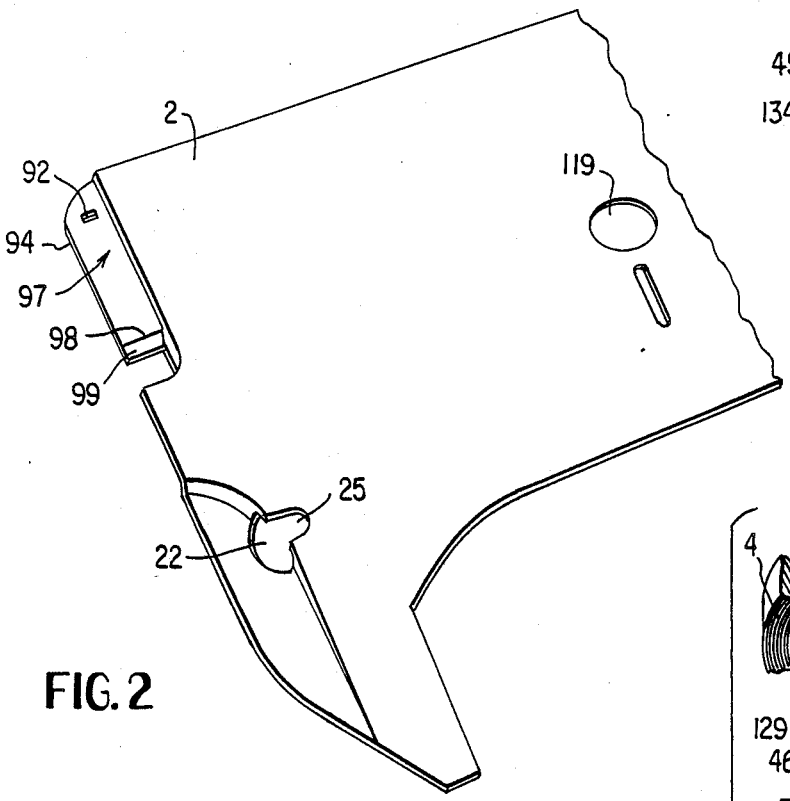
FIG. 2, part of the cover.

FIG. 1 shows a reloadable ribbon cassette 1 for typewriters or office machines of similar construction including an opening 3 on a cup-shaped bottom member 6 in the cassette housing for exchange of a supply spool 4 for unwinding and a take-up spool 5 for winding up a ribbon 8. Opening 3 can be closed by a cover 2. Supply spool 4 can be controlled for blockage or release, respectively, by a braking device while take-up spool 5 is driven by means of the sprocket wheel 9 of a feed roller 10 which can be brought into engagement with ribbon 8 by means of a spring 7. Take-up spool 5 and supply spool 4 are arranged so as to be freely placeable onto bearing pins 11 and 12 on bottom member 6. The movable parts for guiding and transporting ribbon 8 are mounted on one side in the cup-shaped bottom member 6 of the cassette housing and are arranged—except for take-up spool 5 and supply spool 4, which are freely placeable onto bearing pins 11, 12—to be arrested against dropping out of the cassette housing when cover 2 is open. This enables the operator to turn over the cassette housing and simply let supply spool 4 and take-up spool 5 drop out of the cassette housing, once its cover 2 has been opened. Then, a new ribbon spool and a new take-up core are inserted into the cassette housing and, after closing of cover 2, cassette 1 is again inserted into the receptacle of the machine. Thereafter, the typing process can be continued again.

Feed roller 10 with its sprocket wheel 9 are mounted in a bearing bore 13 on a bearing pin 15 which is disposed upright on the bottom 14 of bottom member 6 and is provided with teeth 16 which are in constant engagement with teeth 17 of a drive gear 18. This drive gear 18 is rotatably mounted by means of a bearing pin 19 in a hollow pin 20 at the bottom 14 of bottom member 6. To re-tension ribbon 8, the upper side of drive gear 18 is provided with a hand wheel 21 which is disposed immediately above teeth 17 and projects at least in part through an opening 22 in cover 2 for actuation by means of a finger. Rotation of hand wheel 21 is facilitated by knurling disposed on its surface. Additionally, the upper face and the lower face of bearing pin 19 of drive gear 18 are each provided with a cross-wise slit 23, 24, which can be coupled in a form-locking manner with drive elements inserted through openings 25, 26 in cover 2 and in bottom 14. In this way, drive gear 18 can be securely coupled to transport ribbon 8. Feed roller 10 and its sprocket wheel 9 can be arrested in the axial direction on bearing pin 15 by means of drive gear 18 while drive gear 18 itself is fixed against dropping off from hollow pin 20 by a resilient detent latch 27 mounted at bottom 14. This detent latch 27 is made of one piece with bottom 14 and has a detent tooth 28 at its upright free end. If drive gear 18 is retained on hollow pin 20, this detent tooth projects slightly beyond the surface of hand-wheel 21. Thus, a single detent latch 27 axially arrests feed roller 10 as well as drive wheel 18.

Figure 6:
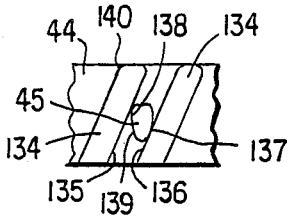
FIG. 6, a detail of FIG. 5.
Figure 5:
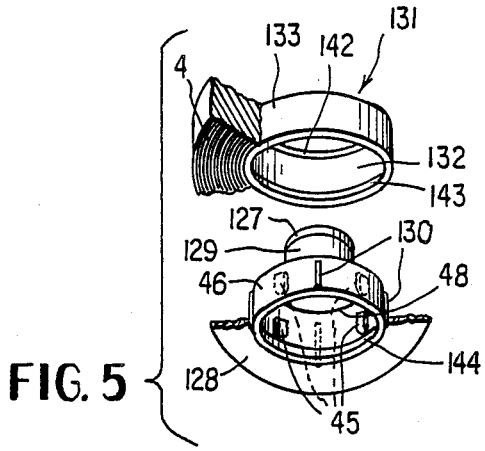
FIG. 5, the hub of the supply spool.

To always keep ribbon 8 tensioned during the typing process, supply spool 4 cooperates with a braking device to block or release the ribbon. For this purpose, supply spool 4 can be coupled in a form-locking manner with a toothed disc 29 rotatably mounted at the bottom 14 of the cassette housing. The blocking tooth 31 of a spring-tensioned (34) ribbon tensioning lever 32 can be brought into and out of engagement with the teeth 30 of this toothed disc 29 so as to block and release, respectively, supply spool 4. Toothed disc 29 is here mounted on a hollow pin 12 of bottom 14 so as to be rotatable and axially arrestable. Moreover, ribbon-tensioning lever 32 has a bearing bore 36 with which it is pivotally mounted on a bearing pin 35 of bottom 14 and can be axially fixed on this bearing pin 35 by means of toothed disc 29. Toothed disc 29 is arrested on hollow pin 12 by a resilient detent latch 39 which is formed by cuts 37, 38 in hollow pin 12. When toothed disc 29 is placed onto hollow pin 12, a detent tab 40 of this detent latch 39 jumps forward with respect to the circumferential face of hollow pin 12 so that toothed disc 29 is axially locked. Additionally, toothed disc 29 is supported by means of spokes 42 formed by recesses 41 on a bearing ring 43 disposed at bottom 14 concentrically with hollow pin 12, thus greatly reducing the bearing friction when toothed disc 29 rotates. Toothed disc 29 is fixed to a gear 44 having sloping teeth which can be coupled in a form-locking manner by means of catch pins 45 in the hub 46 of supply spool 4 when the latter is placed onto bearing pin 12. To facilitate coupling of supply reel 4 with toothed disc 29, a bearing bore 48 in hub 46 is provided with a slope 144 for alignment with respect to toothed wheel 44. Additionally, the frontal faces of the teeth 134 of toothed wheel 44 are provided with rounded portions 140 which further facilitate alignment. Moreover, one end of catch pins 45 is given a wedge shape when seen in the axial direction. This greatly facilitates insertion of catch pin 45 into the gaps 47 between the teeth of toothed wheel 44. After the coupling process, catch pins 45 lie in the tooth gaps 47, each time with a rounded portion 138 lying against the side 135 of a tooth 134 and a wedge face 137 lying against the side 136 of the next tooth 134. After the coupling process with toothed wheel 44, catch pins 45 are disposed approximately in the center of the sloped teeth. In this way, supply spool 4 is prevented from moving freely in the axial direction on bearing pin 12 when ribbon 8 has already been tensioned; instead it must first overcome a considerable friction force. With the ribbon tensioned, the tooth engagement 44/45 always pushes supply spool 4 downwardly against toothed disc 29, see FIG. 6. This also reliably avoids noises generated in prior art machines due to the up-and-down movement of the supply spool on the bearing pins.

The hub of supply spool 4, on the one hand, is provided with a laterally projecting extension 129 in the shape of a hollow cylinder which serves as a handle and is provided with a circumferential gripping bead 127 at its free end to provide a better grip. On the other hand, hub 46 is provided with a support plate 128 for the coiled ribbon, with about one-third of the total of wound layers being supported thereon. In this way, it is avoided that the wound layers disposed immediately on hub 46 are axially displaced if the coil tension slacks off. Such displacement of the wound layers could occur, for example, when supply spool 4 is inserted and would then lead to interference with the process of unwinding from supply spool 4. This is reliably avoided according to the invention by support plate 128.

Since the application of the coiled ribbon on hub 46 and support plate 128 is less suitably performed in automatic machinery, the coiled ribbon is placed onto a core 131 made of an elastic material. This core 131 is composed of a ring 133 whose bearing bore 132 is provided with threading slopes 142, 143 for placement onto hub 46. When ring 133 is placed onto hub 46, it is pushed until it abuts against support plate 128. To ensure reliable engagement in the direction of rotation, hub 46 is provided, for example, with four sprayed-on longitudinal ribs 130. These longitudinal ribs 130 are sloped at their free ends, thus facilitating pushing of core 131 onto hub 46.

Ribbon 8 is guided from supply spool 4 over a first guide roller 50 at the bottom 14 of the cassette, then over a second guide roller 51 on an arm 52 of pivot lever 32 and around a guide pin 54 toward an exit opening 53 in the cassette housing. After passing through the printing station, the ribbon is guided further through an entrance opening 55 in the cassette housing and over a third guide roller 56 at the bottom 14 of the cassette to the take-up spool 5 which is rotatably mounted on a pivot lever 57. This pivot lever 57 is pivotally mounted by means of a bearing pin 117 in a bearing bore 118 of the side wall 77 of bottom member 6. A reset spring 7 articulated at pivot lever 57 keeps take-up spool 5 securely in engagement with sprocket wheel 9 of feed roller 10. Guide rollers 50, 51, 56 are mounted on bearing pins 58, 59, 60 which are provided at their free ends with detent tabs 61, 62, 63 for locking guide rollers 50, 51, 56 on bearing pins 58, 59, 60. In this way, guide rollers 50, 51, 56 are prevented from falling from bearing pins 58, 59, 60 during exchange of the ribbon spools.

The free end of ribbon 8 on the full supply spool 4 is provided with a fastening element, e.g. a guide pin 64 for threading the ribbon 8 around guide points (50, 51, 56) in the cassette. Guide pin 64 has a stub end 113 which is fixed to the free end of ribbon 8, with this pin being guided by means of a handle 112 connected with it. To connect ribbon 8 with take-up spool 5, stub 113 is insertable into a correspondingly configured bearing bore 114 in core 65 of take-up spool 5, with ribbon 8 being conducted from bearing bore 114 through an open slit 115 to the surface of core 65 of take-up spool 5. To enable even less skilled operators to exchange the ribbon spools, the cup-shaped bottom portion 6 of the cassette housing is provided with blocking and guide faces 67, 68, 69, 70 for guide pin 64; these faces extend into the dividing plane 66 toward cover 2 and are arranged around supply spool 4 and in exit slit 53 and entrance slit 55 in bottom member 6. Moreover, pivot lever 32 and its blocking tooth 31, which can be brought into engagement with the teeth 30 of a toothed disc 29, are provided, at an arm 52, with a second guide roller 51, an articulation 71 for a reset spring 34 and a blocking face 72 as well as a guide face 73 for guide pin 64 so that correct threading of ribbon 8 is always ensured. After placing supply spool 4 onto hollow pin 12 and coupling catch pins 45 with the teeth 44 of toothed disc 29, stub end 113 of guide pin 64 is disposed in a recess 116 of blocking face 72. Then the operator performing the exchange grips handle 112 and guides the guide pin, while unwinding ribbon 8 from take-up [sic] spool 4 initially in the direction of the arrow 121 around guide roller 50 and then around guide roller 51 and then in the direction of arrow 122 around guide pin 54 through to exit slit 53. Hereby, stub end 113 is securely guided through a guide slit 124 between blocking faces 70 and 123. When entering into entrance slit 55, stub end 113 securely slides into guide channel 125 formed by the side wall 126 of bottom member 6 and blocking face 67 and toward guide roller 56. Then stub end 113 of guide pin 64 is inserted into the bearing bore 114 of core 65 of take-up spool 15 [sic], whereupon handle 112 is broken off from stub end 113. Breaking handle 112 from stub end 113 may be facilitated by a reduced cross section between these two. The broken-off handle 112, with its cross-shaped cross-sectional area, can then be inserted into the crossed slit 23 of drive gear 18, which makes it very easy to turn drive gear 18, by turning handle 12, so as to tension ribbon 8. In the region of bearing pin 35, the pivotal ribbon tensioning lever 32 is provided with a blocking face 74 extending to the teeth 30 of toothed disc 29. All blocking and guide faces 67, 68, 69, 70, 123, 74, 72 are provided to ensure that guide pin 64 and its stub end 113 are always inserted correctly and are always guided correctly to thread the ribbon.

To remove the full take-up spool 5 and insert a new core 65 for take-up spool 5 on pivot lever 57, it is always necessary to decouple sprocket wheel 9 from the outer turn of take-up spool 5. For this purpose, a hand lever 75 is pivotally mounted in the cassette housing in a recess 76 of the side wall 77 of bottom member 6. Hand lever 75 is here mounted so as to be pivotal into two end positions by means of a bearing pin 78 disposed in a bearing bore 79 in side wall 77. For this purpose, lever 75 is provided, at the upper end of bearing pin 78, with a locking arm 80 which projects from the cassette housing through which cover 2 can be locked in the one end position of hand lever 75 on bottom member 6. At the lower end of bearing pin 78, there is provided an abutment arm 81 which is pivotal over the bottom to charge pivot lever 57 for removal of take-up spool 5 from sprocket wheel 9 of feed roller 10 when the hand lever is moved into the second end position. The free end 82 of abutment arm 81 is provided with a guide groove 83 whose sides 84, 85 grip around a guide face 86 at pivot lever 57. This causes pivot lever 57 to be axially fixed. The bearing bore 79 for bearing pin 78 of hand lever 75 is composed of a hollow pin 87 provided with a longitudinal slot 88 which extends to bottom 14 in such a manner that bearing pin 78 of hand lever 75, when the latter is in a center position between its two end positions and with cover 2 removed from bottom 6, can be pushed into bearing bore 79, causing the abutment arm 81 of hand lever 75 to slide into longitudinal slot 88 until it reaches bottom 14. This ensures easy installation of hand lever 75. The axial fixing of hand lever 75 is effected in that hollow pin 87 is provided, on both sides of longitudinal slot 88 and perpendicularly to it (88) above bottom 14, with guide slots 89 and 90, respectively, for abutment arm 81 of hand lever 75 when the latter is moved into the two end positions. With this configuration, axial displacement of hand lever 75 in both end positions is reliably avoided.

With cover 2 of the cassette housing closed, hand lever 75 can be pivoted into a detent position to lock the cover. In this case, a detent lug 91 of hand lever 75 engages in a detent recess 92 in cover 2. Moreover, cover 2 is provided with a recess 97 corresponding to the locking arm 80 of hand lever 75. The surface of this recess is provided with a raised rib 98 having a sloped ramp 99 for hand lever 75. If hand lever 75 is moved into the detent position, the latter slides over sloped ramp 99 onto raised rib 98 thus securely pressing cover 2 against bottom member 6. Since hand lever 75, when it is moved from the one end position into the detent position, releases pivot lever 57 which is under spring tension, the released spring 7 also charges hand lever 75 into the detent position. During this pivoting movement, core 65 of take-up spool 5 is moved toward sprocket wheel 9 of feed roller 10. To prevent damage to sprocket wheel 9 when core 65 of take-up spool 5 abuts at sprocket wheel 9, detent lug 91 at locking arm 80 of hand lever 75 is provided with a linear abutment face 93 which, upon unlatching of the spring-tensioned pivot lever 57 can be brought into contact with the side edge 94 of cover 2 and with the side wall 95 of bottom member 6, respectively, in such a manner that the core 65 of take-up spool 5 is unable to come in contact with sprocket wheel 9 of feed roller 10. To bring hand lever 75 into the locked position, hand lever 75 must be raised briefly, whereupon detent lug 91 can be latched into detent recess 92 of cover 2. Moreover, detent recess 92 has a rectangular configuration. Detent lug 91 is provided with a sloped face 96 over which hand lever 75 is raised during the rotary movement out of the detent position, with its detent lug 91 thus being automatically lifted out of detent recess 92 of cover 2.

Moreover, cover 2 is pivotally fastened to bottom member 6 of the cassette housing. For this purpose, cover 2 is provided on one side with open bearing tabs 100, 101, which can be pushed onto bearing pins 102, 103 of bottom member 6. Thus, installation of the cover is very simple.

Figure 3A:
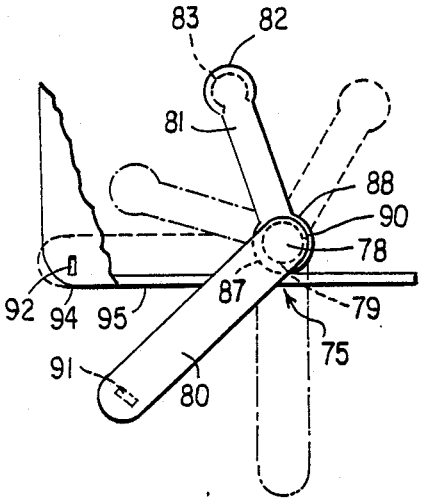
FIG. 3, part of the cassette housing and the hand lever.
Figure 4:
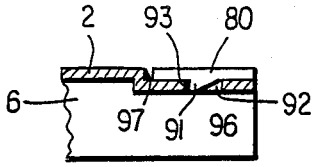
FIG. 4, the hand lever in the locked position.
Figure 3B:
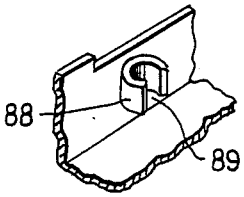

To exchange ribbon spools 4, 5, hand lever 75 must be pivoted out of the detent position into the position show in dash-dot lines in FIG. 3, with pivot lever 57 and the take-up spool being pivoted counterclockwise about bearing axis 117. This causes take-up spool 5 to go out of engagement with sprocket wheel 9 of drive gear 10. During this pivoting movement of pivot lever 57, ribbon tensioning lever 32 is simultaneously pivoted clockwise until detent tooth 31 goes out of engagement with the teeth 30 of toothed disc 29. Now, take-up spool 5 as well as supply spool 4 can easily be removed from bearing axes 11 and 12 by turning over cassette 1.

Since take-up spool 5 and supply spool 4 thus automatically drop down from bearing axes 11 and 12, soiling of the operator's fingers is made impossible. The simultaneous pivoting of ribbon tensioning lever 32 during pivoting of pivot lever 57 is realized in that the free end 104 of pivot lever 57 has an abutment face 105 which produces a counter-abutment face 106 at a second arm 107 of pivotal ribbon tensioning lever 32. Ribbon tensioning lever 32 then has a laterally projecting guide face 107 above counter-abutment face 106 which can be brought into contact with a sloped counter-guide face 108 disposed at pivot lever 57 above abutment face 105. In this way, reliable cooperation between the two pivotal levers (32, 57) is realized.

After insertion of the new ribbon spools 4 and 5, the cover and its bearing tabs 100, 101 which are open on one side are again placed onto bearing pins 102, 103 of the bottom member. After this engagement, cover 2 is pivoted into the closed position whereupon locking arm 80 of hand lever 75 is brought into the detent position shown in dashed lines in FIG. 3.

To ensure easy opening of cover 2 after it has been released by hand lever 75, cassette 1 is provided with a recess 111 in bottom member 6. This recess 111 is disposed at the end of bottom member 6 opposite bearing pins 102, 103.

We claim:

1. In a ribbon cassette for typewriters or office machines of a similar construction including an opening closable by a cover in the top of a cassette housing for the exchange of a supply spool for unwinding and a take-up spool for winding up a ribbon, a plurality of movable drive parts for controlling the supply and take-up spools, said drive parts being arranged in an operative configuration for guiding and transporting said ribbon and including a braking device for blocking and releasing said supply spool, a feed roller equipped with a sprocket wheel for driving the take-up spool and spring means for selectively moving said sprocket wheel into engagement with said ribbon, the improvement wherein said cassette further includes:

bearing pins secured only to a bottom member of said housing, said take-up spool and said supply spool being freely placeable on said bearing pins, and mounting means for mounting the movable drive parts to said bottom member only of the cassette housing, said mounting means including retaining means for securing said drive parts in said operative configuration to prevent said parts from falling out of the cassette housing when the cover is opened.

2. A cassette according to claim 1, wherein the feed roller and the sprocket wheel which has a bearing bore are mounted on a bearing pin which stands upright on the bottom member, with said feed roller being provided with teeth which are in constant engagement with the teeth of a drive gear.

3. A cassette according to claim 2, wherein the drive gear is rotatably mounted by means of a bearing pin in a hollow pin on the bottom member and is provided on its upper face, directly above the teeth, with a hand wheel equipped with knurls, said hand wheel projecting at least in part through an opening in the cover.

4. A cassette according to claim 3, wherein the feed roller and the sprocket wheel can be arrested in the axial direction on the bearing pin by means of the drive gear and the drive gear is fixed by means of a resilient detent latch mounted at the bottom so that it cannot fall off from the hollow pin.

5. A cassette according to claim 4, wherein the detent latch is attached to said bottom at a first end and is provided, at a second free end, with a detent tooth which, when the drive gear is engaged on the hollow pin, projects a small distance beyond the surface of the hand wheel.

6. A cassette according to claim 1, wherein the supply spool is coupled with a toothed disc rotatably mounted on the bottom of the cassette housing, with a blocking tooth of a spring-tensioned pivot lever being brought into and out of engagement with the teeth of said toothed disc for blocking and releasing, respectively, the supply spool, wherein the toothed disc is mounted so as to be rotatable and axially arrestable on a hollow pin of the bottom, and the pivot lever and its blocking tooth are pivotally mounted by means of a bearing bore on a further bearing pin of the bottom and the pivot lever is arranged to be axially fixable on said bearing pin by means of the toothed disc.

7. A cassette according to claim 6, wherein the hollow pin is provided with a resilient detent latch by means of cuts, with its detent tab projecting with respect to the circumferential face of the hollow pin when the toothed disc is placed onto the hollow pin.

8. A cassette according to claim 6, wherein the toothed disc rests with spokes formed by recesses on a bearing ring arranged on the bottom concentric with the hollow pin and is connected with a gear having sloped teeth which can be brought into form-locking engagement with catch pins in the bearing bore of the hub of the supply spool.

9. A cassette according to claim 8, wherein the teeth of the gear having the sloped teeth are provided with rounded portions at their frontal faces and the catch pins which can be brought in contact with the rounded portions are given a wedge-shaped configuration in the axial direction.

10. A cassette according to claim 9, wherein the bearing bore is provided with a slope in front of the wedge-shaped ends of the catch pins for centering with respect to the gear, and the hub is provided with a support plate for the coiled ribbon, with said support plate being positioned concentric with the bearing bore and with a cylindrical projection having a gripping bead for better gripping.

11. A cassette according to claim 10, wherein the coiled ribbon is disposed on an annular core composed of elastic material, with the core being pushable onto the hub until it abuts at the support plate, and the hub is provided with longitudinal ribs sloped for pushing on the core and which can be coupled with the core in a form-locking manner.

12. A cassette according to claim 1, wherein the ribbon is conducted from the supply spool over a first guide roller on the bottom of the cassette and then over a second guide roller on an arm of a first pivot lever to an exit opening in the cassette housing and then through an entrance opening in the cassette housing and over a third guide roller on the cassette bottom to the take-up spool which is rotatably mounted on a second pivot lever, wherein the guide rollers are mounted on further bearing pins secured to said bottom whose free ends are provided with detent tabs for locking the guide rollers on the bearing pins.

* * * * *